US006914083B2

(12) United States Patent
Hensman

(10) Patent No.: US 6,914,083 B2
(45) Date of Patent: Jul. 5, 2005

(54) FISCHER-TROPSCH PROCESS

(75) Inventor: John Richard Hensman, Letchworth (GB)

(73) Assignee: Davy Process Technology Ltd., London (GB)

( * ) Notice: Subject to any disclaimer, the term of this patent is extended or adjusted under 35 U.S.C. 154(b) by 256 days.

(21) Appl. No.: 10/363,417

(22) PCT Filed: Sep. 28, 2001

(86) PCT No.: PCT/GB01/04372

§ 371 (c)(1),
(2), (4) Date: Mar. 3, 2003

(87) PCT Pub. No.: WO02/26667

PCT Pub. Date: Apr. 4, 2002

(65) Prior Publication Data

US 2004/0014825 A1 Jan. 22, 2004

(30) Foreign Application Priority Data

Sep. 28, 2000 (GB) ..... 0023781

(51) Int. Cl.[7] ..... C07C 27/00
(52) U.S. Cl. ..... 518/700; 518/712; 518/715
(58) Field of Search ..... 518/700, 715, 518/712

(56) References Cited

U.S. PATENT DOCUMENTS 4,729,981 A 3/1988 Kobylinski et al.
4,874,732 A 10/1989 Miller et al.

(Continued)

OTHER PUBLICATIONS

E. Iglesia, et al. "Selectivity Control and Catalyst Design in the Fischer–Tropsch Synthesis: Stiles, Pellets, and Reactors", Advances in Catalysis, vol. 39, 1993, pp. 221–302.
S. T. Sie, et al. "Fundamentals and selection of advanced Fischer–Tropsch reactors" Applied Catalysis, A: General 186, 1999, pp. 55–70.
H.E. Benson et al., "Air Circulation Process for Fischer–Tropsch Synthesis", Engineering, Design, and Process Development,vol. 46,No. 11, Nov.1954, pp. 2278–2285.

*Primary Examiner*—J. Parsa
(74) *Attorney, Agent, or Firm*—Davidson, Davidson & Kappel, LLC

(57) ABSTRACT

A process for producing a liquid hydrocarbon product from hydrogen and carbon monoxide comprises: (a) providing a reaction vessel containing a slurry of particles of a particulates Fischer Tropsch catalyst in a liquid medium comprising a hydrocarbon, the particles of catalyst having a particle size range such that no more than about 10% by weight of the particles of catalyst have a particle size which lies in an upper particle size range extending up to a maximum particle size, (b) supplying hydrogen and carbon monoxide to the reaction vessel, (c) maintaining in the reaction vessel reaction conditions effective for conversion of hydrogen and carbon monoxide to a liquid hydrocarbon product by the Fischer Tropsch reaction, (d) maintaining mixing conditions in the reaction vessel sufficient to establish a circulation pattern throughout the reaction vessel including an upflowing path for slurry and a downflowing path for slurry, the upward velocity of the slurry in the upflowing slurry path being greater than about 75% of the mean downward velocity of the particles of catalyst of the upper particle size range when measured in stagant liquid medium, the reaction vessel being substantially devoid of stagnant zones wherein the catalyst particles can settle out of the slurry, (e) recovering from the reaction vessel a liquid stream comprising the liquid hydrocarbon product; and (f) recovering from the reaction vessel an offgas stream comprising methane as well as unreacted hydrogen and carbon monoxide.

36 Claims, 3 Drawing Sheets

U.S. PATENT DOCUMENTS 5,023,277 A 6/1991 McAteer
5,102,851 A 4/1992 Eri et al.
5,348,982 A 9/1994 Herbolzheimer et al.
5,384,336 A 1/1995 Koros
5,545,674 A 8/1996 Behrmann et al.
5,776,988 A 7/1998 Chaumette et al.
5,827,902 A 10/1998 Maretto et al.
5,900,159 A 5/1999 Engel et al.
5,968,991 A 10/1999 Mauldin
5,973,012 A 10/1999 Behrmann et al.
6,068,760 A 5/2000 Benham et al.
6,069,179 A 5/2000 Rytter et al.
6,076,810 A 6/2000 Chang et al.
6,087,405 A 7/2000 Plecha et al.
6,100,304 A 8/2000 Singleton et al.

FISCHER-TROPSCH PROCESS

BACKGROUND OF THE INVENTION

This invention relates to a process for producing a liquid hydrocarbon product by a Fischer Tropsch process.

Although the Fischer Tropsch synthesis has been known since 1923, it has failed to gain widespread commercial use due to the disappointing performance of those process plants which have already been constructed and to the high investment demands required for developing more effective systems. Only in countries such as South Africa, where unique economic factors come into play, has the process achieved any kind of commercial significance.

The Fischer Tropsch synthesis attracts interest because, in combination with other processes, it may be used to convert the large supplies of natural gas which are found in remote locations of the world to usable liquid fuel. The synthesis involves the conversion of synthesis gas, i.e. a gas containing hydrogen and carbon monoxide (which can be obtained by conversion of natural gas), to a liquid hydrocarbon product using a suitable catalyst. The specific reactions taking place, and hence the composition of the end product, depend upon the reaction conditions. These include the ratio of hydrogen to carbon monoxide and the catalyst used. Generally the reactions taking place may be depicted as follows:

$$(2n+1)H_2+nCO \rightarrow C_nH_{2n+2}+nH_2O$$

$$(n+1)H_2+2nCO \rightarrow C_nH_{2n+2}+nCO_2$$

$$2nH_2+nCO \rightarrow C_nH_{2n}+nH_2O$$

$$nH_2+2nCO \rightarrow C_nH_{2n}+nCO_2$$

Byproducts of this reaction include gaseous hydrocarbons, such as methane and ethane.

Suitable catalysts for the synthesis can be found amongst the Group VIII metals. There has been much interest in developing and modifying suitable catalysts in an attempt to improve the commercial viability of the Fischer Tropsch synthesis. Thus U.S. Pat. No. 6,100,304 describes a palladium promoted cobalt catalyst providing a significant activity enhancement comparable to effects seen with rhodium promoted cobalt catalysts. In U.S. Pat. No. 6,087,405 it is stated that Fischer Tropsch synthesis conditions, in particular use of relatively high water partial pressures, can lead to weakening of the catalyst resulting in the formation of fines in the reaction mixture. Catalyst supports are described which are comprised primarily of titania incorporating both silica and alumina which have increased strength and attrition resistance qualities when compared to previous catalyst supports. U.S. Pat. No. 5,968,991 describes a Fischer Tropsch catalyst comprising a titania solid support impregnated with a compound or salt of an appropriate Group VIII metal, a compound or salt of rhenium and a multi-functional carboxylic acid. The multi-functional carboxylic acid acts to facilitate distribution of the compound or salt of the Group VIII metal in a highly dispersed form, thus reducing the amount of rhenium required to produce both dispersion and reduction of the metal. U.S. Pat. No. 5,545,674 teaches a supported particulate cobalt catalyst formed by dispersing the cobalt as a thin catalytically active film upon the surface of a particulate support such as silica or titania. U.S. Pat. No. 5,102,851 discloses that the addition of platinum, iridium or rhodium to a cobalt catalyst supported on an alumina carrier, without additional metal or metal oxide promoters, provides a higher than expected increase in the activity of the catalyst for Fischer Tropsch conversions. U.S. Pat. No. 5,023,277 describes a cobalt/zinc catalyst which is said to be very selective to hydrocarbons in the $C_5$ to $C_{60}$ range and enables the synthesis to be operated under conditions of low carbon dioxide make and low oxygenates make. U.S. Pat. No. 4,874,732 teaches that the addition of manganese oxide or manganese oxide/zirconium oxide promoters to cobalt catalysts, combined with a molecular sieve, results in improved product selectivity along with enhanced stability and catalyst life.

With a view to further improving the viability of the Fischer Tropsch synthesis aspects of slurry processes have also been investigated, such as product removal, catalyst rejuvenation, catalyst activation, gas distribution and adaptation of reactor designs. U.S. Pat. No. 6,069,179 comments that a problem associated with slurry reactors used to effect the Fischer Tropsch synthesis is separation of the catalyst from the product stream in a continuous operation. This problem is addressed by providing a pressure differential filter member. U.S. Pat. No. 6,068,760 tackles the same problem by feeding a portion of the slurry through a dynamic settler which enables clarified wax to be removed from the slurry which is then returned to the reactor. U.S. Pat. No. 5,900,159 employs a method of degasifying the slurry and passing it through a cross-flow filter in order to separate the product from the solid catalyst. U.S. Pat. No. 6,076,810 comments that problems commonly encountered in slurry reactors, amongst others, are gas injector plugging and catalyst particle attrition. A proposed solution is provided by means of a gas distribution grid which includes a plurality of gas injectors horizontally arrayed across a plate which is otherwise gas and liquid impervious. U.S. Pat. No. 5,973,012 proposes to rejuvenate deactivated Fischer Tropsch catalyst by subjecting a portion of the slurry from the reactor to degasification, contacting the degasified slurry with a suitable rejuvenating gas and then returning it to the reactor. U.S. Pat. No. 4,729,981 relates to the provision of both promoted and unpromoted, supported cobalt and nickel catalysts activated by reduction in hydrogen, followed by oxidation with an oxygen-containing gas and ultimately, a second reduction in hydrogen. Such activation results in improved reaction rates regardless of the method of preparation of the catalyst. U.S. Pat. No. 5,384,336 teaches a multi-tubular configuration for a bubble column type reactor, while U.S. Pat. No. 5,776,988 proposes an ebulliating reactor, to obtain enhanced heat transfer through the system and the prevention of hot spots.

Reviews of Fischer Tropsch reactor designs have been published by Iglesia et al., Advances in Catalysis, Vol. 39, 1993, 221–301 and Sie and Krishna, Applied Catalysis A General, 186, (1999), 55–70.

There are several different configurations of Fischer Tropsch reactors, including fixed bed multitubular reactors, vapour phase fluidised bed reactors and slurry or three phase reactors.

In general, slurry or three phase reactors have the advantage that it is possible to use small catalyst particles without the occurrence of high pressure drop problems which feature in fixed bed reactors. Moreover use of small catalyst particles has been shown to reduce the yield of methane as demonstrated by Iglesia et al., Advances in Catalysis, Vol. 39, 1993, 221–301.

In general, designs for Fischer Tropsch reactors have adopted a "long and thin" construction as this has proved to be a suitable design to allow sufficient heat removal and allows realization of the benefit of plug flow conditions. In plug flow systems the catalyst is stationary relative to the flow of the gas and liquid phases. As the feed stream enters the reactor the reactants begin to convert to products and this conversion continues as the feed stream continues through the reactor. A consequence of this is that the concentration and partial pressure of the reactants decrease as the feed stream passes through the reactor and the concentration of product increases, resulting in a drop in the driving force for the reaction. The required volume of the reactor for most straight-forward processes, where the rate of reaction is dependent upon the concentration of the reactants, can be reduced when compared to other systems, therefore enabling a significant cost saving to be made in the construction of the plant.

Benson et al, IEC, vol 46, No 11, November 1954, describe an oil circulation process for the Fischer Tropsch synthesis in which the oil circulation cools the reaction product. The process employs a reactor with a height to diameter ratio of 12 or more and gas is bubbled up through the liquid phase at a superficial velocity below 0.03 m/sec in order to avoid catalyst disintegration.

Fully back mixed reactors (CSTR) are a standard design option for laboratory scale reactors for use with many different processes, including the Fischer Tropsch synthesis. These laboratory scale reactors employ an agitator to provide mixing and solid distribution, and are used to investigate reaction kinetics under uniform conditions. The rate of conversion of reactants to products, along with the product selectivity, depends upon the partial pressure of the reactants that are in contact with the catalyst. The mixing characteristics of the reactor determine the gas phase composition which is critical to catalyst performance. In fully back mixed reactors (CSTR) the composition of the gas and liquid phases is constant throughout the reactor and the gas partial pressure provides the driving force for the reaction, thus determining the conversion of the reactants.

U.S. Pat. No. 5,348,982 compares the fully back mixed reactor (CSTR) system with that of the plug flow system and concludes that the productivity of the fully back mixed reactor (CSTR) system will always be lower than the productivity of the plug flow system for reactions with positive pressure order kinetics. This is because the gas phase reactant concentrations providing the driving force for the reaction differ significantly between the two systems. The reactant concentration, and hence reaction rate, at any point in a fully back mixed reactor (CSTR) system, will always correspond to the outlet conditions. In a plug flow system, as the reactant concentration steadily decreases between the inlet and outlet, the rate of reaction is the integral of the rate function from inlet to outlet. U.S. Pat. No. 5,348,982 proffers a slurry bubble column which addresses the problems associated with the scale-up of laboratory practices on a commercial scale. The bubble column is operated under plug flow conditions and employs a gas up-flow sufficient to achieve fluidisation of the catalyst, but back mixing of the reactants is minimised.

U.S. Pat. No. 5,827,902 describes a process for effecting the Fischer Tropsch synthesis in a multistage bubble column reactor paying particular attention to the problem of thermal exchanges, which is a significant problem in systems utilised for exothermic reactions such as the Fischer Tropsch synthesis.

SUMMARY OF THE INVENTION

When operating a system under plug flow conditions there exists a temperature profile from the inlet to the outlet of the reactor, generally with a peak temperature near the middle of the reactor. This profile prevents the entirety of the reactor being operated at the optimum temperature for the reaction. An increase in temperature not only increases the reaction and plant production rates but also increases the make of methane faster than the desired product reactions. Methane is an unwanted byproduct of the synthesis.

Two or more moles of hydrogen are consumed per mole of carbon monoxide if a saturated hydrocarbon is produced, but three moles of hydrogen are consumed per mole of carbon monoxide if methane is produced. It is known that in order to minimise the production of methane, it is necessary to maintain the ratio of the partial pressures of hydrogen and carbon monoxide less than 2:1 in the reactor. The only way that even an approximately constant ratio of the partial pressures can be sustained along the length of a plug flow reactor is to feed the gases into the reactor at the same rates that they are being consumed. However, this does not provide the optimum set of conditions for the Fischer Tropsch synthesis. Additionally, the low velocities required to maintain plug flow conditions reduce the heat transfer rate between the reacting medium and the cooling surfaces that have to be provided to remove the heat of reaction. Furthermore, the low velocities, in combination with the lack of mixing, result in catalyst particles being segregated according to size along the length of the reactor. The larger particles tend to accumulate at the bottom of the reactor whereas smaller particles accumulate at the top. This segregation of the catalyst particles can cause uneven reaction rates throughout the reactor and, hence, uneven temperatures result. Moreover, the low velocities and lack of turbulence allow gas bubbles to coalesce. This results in a reduction of the interfacial area available between the gas and liquid phases for dissolving the reactive gases in the liquid and for removing the byproducts, water and methane, from the liquid into the gas phase. If the interfacial surface area between the gas and liquid is allowed to reduce considerably below the surface area of the catalyst in a volume of the reaction medium, then the reduced interfacial surface area between the gas and the liquid can limit the rate of reaction on the catalyst. This is because the concentration of the reactants in the liquid phase is reduced. Also, the low velocities involved in plug flow systems allow the catalyst particles to agglomerate, giving a larger average catalyst particle size and a lower effective surface area than desirable. Finally, as there is a large variation in composition along the length of the plug flow reactor, reaction stability must be maintained by using a narrow temperature difference between the reaction medium and the coolant medium which is used to remove the heat of reaction. If the temperature of the reaction medium increases by a small amount, the rate of heat removal must increase faster than the rate of heat generation due to the increased rate of reaction at the higher temperature. The narrow temperature difference between the reaction medium and the coolant medium requires a large surface area for the cooling surfaces and this increases the cost of the equipment.

Accordingly, the present invention seeks to provide an improved process for the Fischer Tropsch synthesis which overcomes the aforementioned problems exhibited in the prior art. In addition the present invention seeks to provide a greater yield of valuable products from the feed gases. Moreover it is another objective of the invention to improve the economics of the overall process for converting methane to liquid hydrocarbon.

The present invention accordingly provides a process for producing a liquid hydrocarbon product from hydrogen and carbon monoxide which comprises:

(a) providing a reaction vessel containing a slurry of particles of a particulate Fischer Tropsch catalyst in a liquid medium comprising a hydrocarbon, the particles of catalyst having a particle size range such that no more than about 10% by weight of the particles of catalyst have a particle size which lies in an upper particle size range extending up to a maximum particle size, (b) supplying hydrogen and carbon monoxide to the reaction vessel, (c) maintaining in the reaction vessel reaction conditions effective for conversion of hydrogen and carbon monoxide to a liquid hydrocarbon product by the Fischer Tropsch reaction, (d) maintaining flow conditions in the reaction vessel sufficient to establish a circulation pattern throughout the reaction vessel including an upflowing path for slurry and a downflowing path for slurry, the upward velocity of the slurry in the upflowing slurry path being greater than about 75% of the mean downward velocity of the particles of catalyst of the upper particle size range when measured under unhindered settling conditions in stagnant liquid medium, the reaction vessel being substantially devoid of stagnant zones wherein the catalyst particles can settle out of the slurry, (e) recovering from the reaction vessel a liquid stream comprising the liquid hydrocarbon product.

Furthermore, the current invention provides a process for production of a liquid hydrocarbon product from carbon monoxide and hydrogen which comprises:

(a) providing a reaction vessel containing a slurry of a particulate Fischer Tropsch catalyst in a liquid medium comprising hydrocarbon;

(b) providing a first gas stream selected from hydrogen and a synthesis gas mixture comprising hydrogen and carbon monoxide in a molar ratio greater than about 2:1;

(c) providing a second gas stream comprising hydrogen and carbon monoxide in a molar ratio less than about 2:1;

(d) continuously supplying material of the first gas stream and material of the second gas stream to the reaction vessel;

(e) maintaining back mixed circulation of the slurry in the reaction vessel whereby a circulation pattern is maintained throughout the reaction vessel without zones of stagnation wherein particles of the particulate Fischer Tropsch catalyst settle out;

(f) maintaining conditions of temperature and pressure within the reaction vessel effective for conversion of hydrogen and carbon monoxide by the Fischer Tropsch reaction to a liquid hydrocarbon product;

(g) recovering from the reaction vessel an offgas stream comprising methane as well as unreacted hydrogen and carbon monoxide;

(h) monitoring the composition of the offgas stream; and (i) adjusting the hydrogen:carbon monoxide molar ratio in the reaction vessel in dependence upon the composition of the offgas stream by varying the flow rate to the reaction vessel of at least one gas stream selected from the first synthesis gas stream and the second synthesis gas stream so as to maintain in the reaction vessel conditions conducive to synthesis of the liquid hydrocarbon product.

The particulate Fischer Tropsch catalyst employed for the process of the invention typically comprises a Group VIII metal on a support. The support may be titania, zinc oxide, alumina or silica-alumina. Preferably the particulate Fischer Tropsch catalyst comprises cobalt on a support. The Fischer Tropsch catalyst particles have a particle size range preferably a range of from about 2 $\mu$m to about 100 $\mu$m, more preferably of from about 5 $\mu$m to about 50 $\mu$m. By use of catalyst of a narrow range of catalyst particle size which is evenly distributed throughout the reactor under the slurry flow conditions of the present invention, uneven heat generation by the reaction due to segregation of different catalyst particle sizes and unequal catalyst particle concentrations at different locations in the reactor is substantially obviated.

Determination of the mean downward velocity of the particles of the upper particle size range should be conducted under unhindered settling conditions in a stagnant suspension having a dilute concentration of solids in liquid reaction medium, for example in a stagnant suspension in liquid reaction medium containing less than about 5% solid matter in the liquid.

The particle size distribution of the Fischer Tropsch catalyst can be determined, for example by laser diffraction, electrozone measurement or by a combination of sedimentation and X-ray absorption measurement. In this way the upper particle size range can be determined, that is to say the range of particle size up to and including the maximum particle size within which the largest 10% by number of the particles in the selected sample fall. From this measurement it is then possible to determine by calculation a settling velocity for particles within the upper particle size range under unhindered settling conditions in stagnant liquid reaction medium, i.e. in a liquid hydrocarbon mixture of the composition present in the Fischer Tropsch reactor. This settling velocity can alternatively be described as the mean downward velocity of the particles of catalyst of the upper particle size range when measured in the form of a dilute suspension in stagnant liquid medium. In this way the minimum upward velocity of the slurry in the upflowing path for slurry to be used in the process forming one aspect of the present invention can be determined.

A substantially uniform temperature is maintained throughout the reaction zone which can be controlled at the optimum temperature for productivity and selectivity of the Fischer Tropsch reaction. The reaction vessel is preferably operated at a temperature between about 180° C. and about 250° C. The energy dissipation within the reaction zone is preferably between about 0.2 $kW/m^3$ and about 20 $kW/m^3$, more preferably between about 1.5 $kW/m^3$ and about 7 $kW/m^3$.

The reaction vessel may contain an internal heat exchanger for removal of heat of reaction. Alternatively slurry can be withdrawn from the reaction vessel and pumped through an external loop including an external heat exchanger for removal of heat of reaction. Such an external loop may also include an external filter permitting recovery of liquid reaction product while retaining catalyst particles in the circulating slurry. Alternatively an internal filter can be provided within the reaction vessel for the same purpose.

The use of the slurry mixing conditions of the present invention also ensures that the composition of the gas/liquid composition is substantially uniform throughout the entire volume of the reactor and also allows the ratios of the partial pressures of hydrogen and carbon monoxide to be maintained at the optimum value to balance productivity with production capacity. Preferably the reaction vessel is operated at a pressure between about 1000 kPa and about 5000 kPa absolute total pressure. More preferably the reaction vessel is operated at a pressure between about 2000 kPa and about 4000 kPa absolute total pressure.

A high degree of turbulence is created in the reaction vessel by a mixing means, for example by using a venturi mixer, an impeller, or a pair of impellers, which is or are preferably mounted on the axis of the reactor. The mixing action of the mixing means creates a circulation pattern within the reaction vessel. The circulation pattern includes an upflowing path and a downflowing path for slurry. It is preferred that the upward velocity of the slurry is greater than about 75% of the mean downward velocity of the particles of catalyst in the upper particle size range when measured under unhindered settling conditions in a dilute suspension in stagnant liquid medium. More preferably, the upward velocity of the slurry is greater than the downward velocity of the largest particle of catalyst when measured under unhindered settling conditions in a dilute suspension in stagnant liquid medium. A consequence of the maintenance of the circulation pattern within the reaction vessel is that the reaction vessel is substantially devoid of stagnant zones in which the catalyst particles can settle out of the slurry.

If a reaction vessel of circular horizontal cross section is used, it is possible to establish a substantially toroidal flow path for slurry within the reaction vessel with a first axial flow path generally aligned with the axis of the reaction vessel and with a second flow path, in which the direction of flow is opposite to that in the first flow path, adjacent to and substantially parallel to the walls of the reaction vessel. The first flow path may be an upward flow path or a downward flow path while the direction of flow in the second flow path is downward or upward respectively, being opposite to that of the first flow path in either case.

The circulating flowpath or a part of it may be physically subdivided into sections which operate in parallel, provided that the subdivisions achieve equivalent conditions for the reaction. Thus the reaction vessel may be provided with a baffle or baffles to assist in maintaining a desired circulation pattern within the reaction vessel. For example, the reaction vessel may include a tubular insert whose axis is aligned with the vertical axis of the reaction vessel so as to separate the upflowing path from the downflowing path. Such an insert may be supported by radial vanes which extend between the tubular insert and the walls of the reaction vessel so as to subdivide the upflowing path into a plurality of aligned flow streams.

The turbulence generates a high interfacial area between the gas and liquid phases and reduces the mass transfer resistances between the gas and liquid phases. Thus, a high rate of mass transfer from the gas to the liquid phases is achieved, avoiding the reduction of the effective partial pressure of the reactants in the reactor liquid, and enabling vapour byproducts, such as water and methane, to be rapidly removed so increasing the rate of reaction. Such high rates of mass transfer are not possible within commercial reactors designed to achieve a close approximation to plug flow. To facilitate the mass transfer, gas entering the reaction vessel may be provided to locations which are highly turbulent as a result of the circulation pattern. It is preferred that a main gas stream may be provided to a top head space or to a bottom head portion of the reaction vessel. Part of the offgas may be purged in order to limit the build-up on inert gases in the circulating gas while the remainder is recirculated to the reaction vessel. In that case it is advantageous to return the recirculated offgas to a highly turbulent location in the reaction zone.

The stability of the reactor system can be maintained by controlling the composition through manipulation of the feed rates of the two gas streams. As a result, larger temperature differences than in plug flow systems can be employed, both between the reactants and the coolant and also between the inlet and the outlet of a cooler, which may or may not be external to the reaction zone. The increased temperature difference between the reactants and the coolant allows a reduction in head transfer area. This is enhanced by the high velocities used which increase the heat transfer coefficient for the heat transfer area. The advantage of improved heat transfer can be maintained where a high coolant exit temperature provides an overall economic advantage, by allowing the heat generated by the Fischer Tropsch reaction to be delivered to an external system at a higher temperature than would be possible in other inventions which do not provide a high heat transfer coefficient.

The catalyst particles charged to the reaction vessel may be expected to undergo some attrition in size due to the turbulent mixing conditions used in the present invention.

It is envisaged that multiple reaction vessels operating in parallel or in series may be employed in order to meet the required capacity of a commercial plant. Furthermore it is envisaged that fresh catalyst may be added to the reaction vessel during the course of operation. This allows compensation to be made for any loss of catalyst activity that may result from the extended operation of the catalyst over time.

DESCRIPTION OF THE DRAWINGS

In order that the invention may be clearly understood and readily carried into effect some preferred embodiments thereof will now be described, by way of example only, with reference to the accompanying schematic drawings, in which.

DETAILED DESCRIPTION OF THE INVENTION

Figure 1:
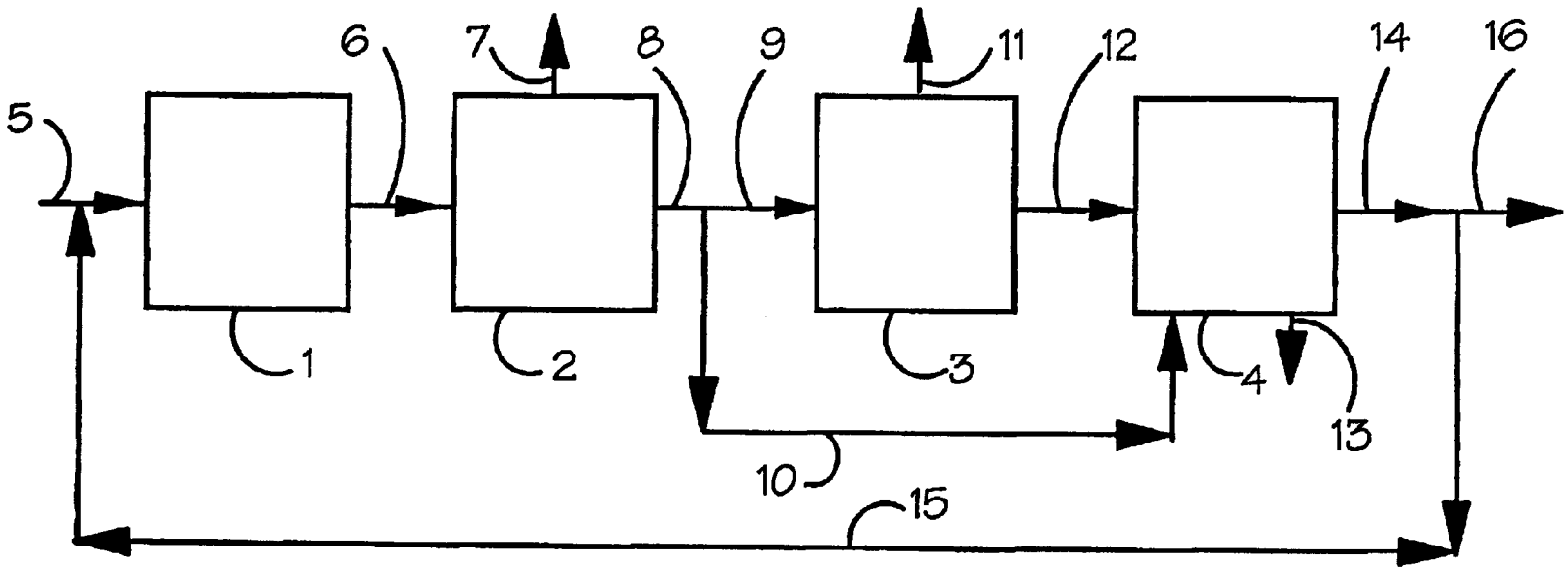
FIG. 1 shows a block diagram of a commercial liquid hydrocarbon synthesis plant utilising the Fischer Tropsch process.

In FIG. 1 there is shown a plant for the production from methane or natural gas of a liquid hydrocarbon stream by the Fischer Tropsch process comprising a steam reformer 1, a first stage gas separator 2, a second stage gas separator 3 and a. Fischer Tropsch reactor 4. Crude synthesis gas is generated in steam reformer 1.

The natural gas or methane feed stream is supplied in line 5 to steam reformer 1. The principal reaction in the steam reformer 1 is:

$$CH_4+H_2O \rightarrow CO+3H_2$$

The resulting crude synthesis gas thus has a hydrogen:carbon monoxide molar ratio close to 3:1 in place of the desired feed molar ratio of about 2.1:1. This crude synthesis gas is accordingly passed in line 6 to first stage gas separator 2, which may comprise a membrane made from hollow polymeric fibres, for example a "Medal" membrane sold by Air Liquide.

A first hydrogen stream is recovered in line 7. The resulting carbon monoxide enriched gas, which still has a hydrogen:carbon monoxide molar ratio significantly higher than the desired 2.1:1 feed molar ratio, for example about 2.3:1, passes on in line 8. A part of this stream, which has a hydrogen:carbon monoxide molar ratio which is higher than desired for Fischer-Tropsch synthesis, is fed forward in line 9 to second stage gas separator 3 which also comprises a membrane. The remainder is fed by way of line 10 to Fischer-Tropsch reactor 4.

From second stage gas separator 3 there is recovered in line 11 a second hydrogen stream.

A synthesis gas stream, which is now further enriched with carbon monoxide in comparison with the stream in line 9 is recovered from second stage gas separator 3 in line 12. Typically this has a hydrogen:carbon monoxide molar ratio of about 1.9:1, i.e. less than the stoichiometric requirement for Fischer-Tropsch synthesis. This is mixed with the stream in line 10 to yield a gas mixture with the desired 2.1:1 feed molar ratio.

A mixture of offgas and liquid is recovered from Fischer-Tropsch reactor 4. This is separated in any convenient manner into a liquid product stream and a gas stream. The liquid product in line 13 is passed forward for further processing and to storage. The offgas stream in line 14 is mainly recycled to the steam reformer 1 in line 15. A purge gas stream is taken in line 16 to prevent undue build-up of inert gases in the circulating gas.

In operation of the plant of FIG. 1 the composition of the feed gas and the temperature and pressure conditions are selected to give a desirably low proportion of byproduct methane in the offgas in line 14. During operation the composition of the offgas is monitored continuously, for example by mass spectroscopy, and if the proportion of methane in the offgas rises to an unacceptable level, then the quantity of gas supplied in line 10 is reduced and/or the quantity of gas supplied in line 12 is increased, thereby reducing the hydrogen:carbon monoxide molar ratio to a value better suited for synthesis of a liquid hydrocarbon product bearing in mind the current activity of the Fischer Tropsch catalyst. The partial pressures of hydrogen and carbon monoxide can therefore be controlled in the off gas to give the required production rate and optimum selectivity.

Figure 2:
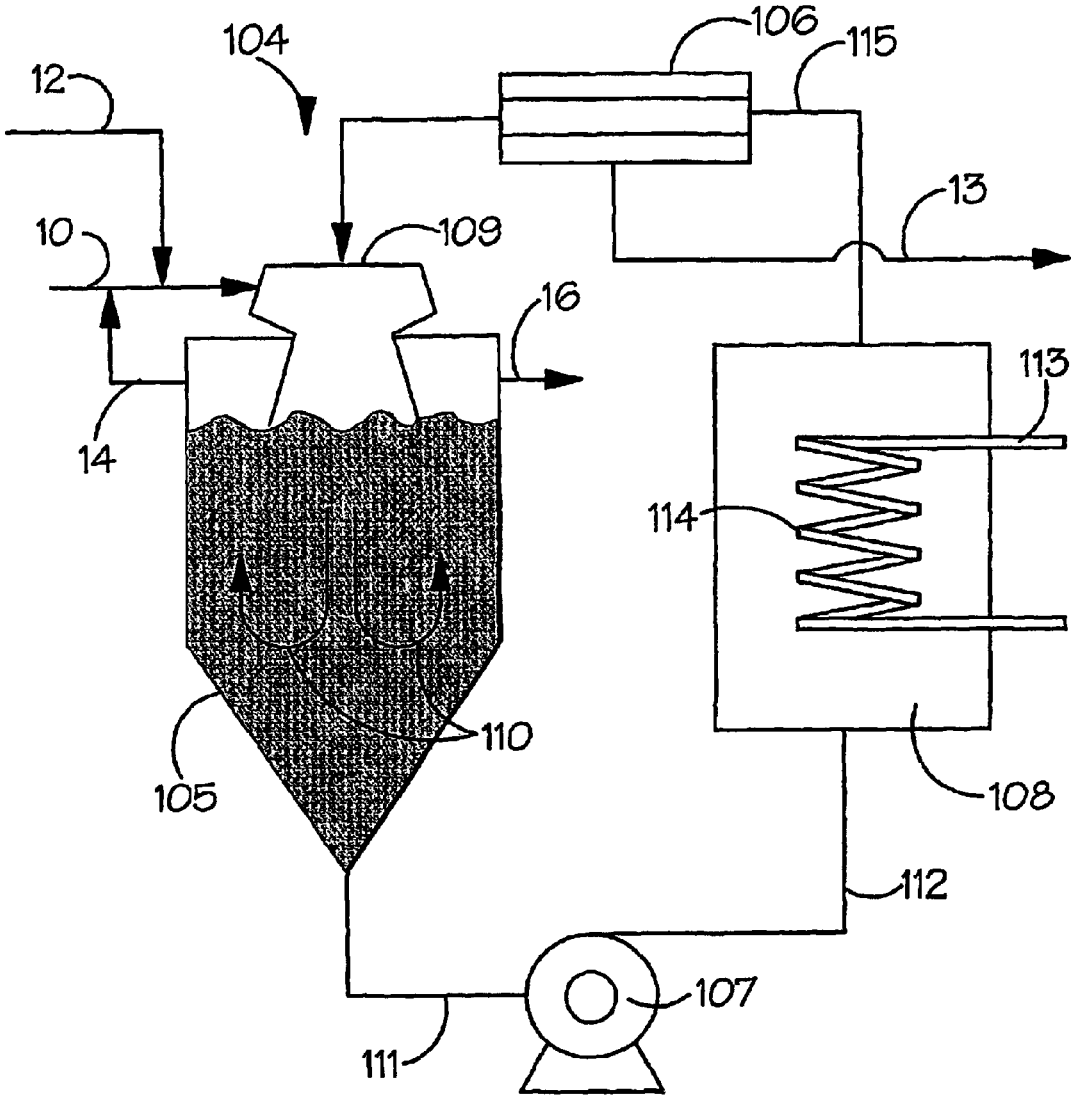
FIG. 2 shows a first form of reactor for use in the plant of FIG. 1.

In FIG. 2 there is shown a design of reactor 104 for use as the reactor 4 in the plant of FIG. 1. This comprises a reaction vessel 105, an external filter 106, a pump 107 and a heat exchanger 108. Reaction vessel 105 contains a slurry of liquid hydrocarbon product and Fischer Tropsch catalyst. Typically the catalyst is a supported cobalt catalyst having a particle size range of from about 2 $\mu$m up to about 50 $\mu$m and the concentration of catalyst particles in the slurry is about 20% by volume. Reaction vessel 105 is supplied with a first hydrogen rich synthesis gas stream in line 10 having a hydrogen:carbon monoxide ratio of about 1.9:1 at a rate of about 4 $m^3$/sec (measured at 0° C. and at 1 bar) and with a carbon monoxide rich gas stream having a hydrogen:carbon monoxide molar ratio of about 2.3:1 at a rate of about 4.4 $m^3$/sec (measured at 0° C. and at 1 bar) in line 12. The resulting mixed feed gas is injected into reaction vessel 105 through gas injector 109 and causes a circulation pattern to be maintained, as indicated diagrammatically by arrows 110, of sufficient vigour to provide an upflowing liquid velocity that is at least about 1.5 m/sec, i.e. a velocity that is least about 1.25 times the mean settling velocity of the largest catalyst particles present. Since reaction vessel 105 is of substantially circular horizontal cross section the circulation pattern is effectively substantially toroidal with a downflowing path along and generally aligned with the vertical axis of the reaction vessel and with an upflowing path adjacent to and substantially parallel to the walls of the reaction vessel 105.

Reaction vessel 105 is maintained at a temperature of 200° C. and at a pressure of about 2500 kPa.

Slurry is withdrawn from the bottom of reaction vessel 105 in line 111 under the influence of pump 107 and is pumped via line 112 to heat exchanger 108 in which it is cooled, by heat exchange against a suitable cooling fluid, e.g. cold water, supplied in line 113 to an internal heat exchanger 114. The cooled slurry from heat exchanger 108 passes on in line 115 to filter 106 from which a liquid product stream is recovered in line 13 for further treatment, such as degasification, phase separation and distillation.

The remaining slurry is recycled in line 116 to injector 109.

A purge gas stream is recovered from the top head space of reaction vessel 105 in line 16, the remainder of the offgas being recovered in line 14. The composition of the gas of stream 14 or stream 16 is monitored by any suitable method, such as mass spectroscopy. If the ratio of the partial pressures of the hydrogen and carbon monoxide in the offgas is greater than that desired to maintain catalyst activity and to produce a high proportion of liquid hydrocarbons and an acceptably low proportion of methane, then the proportion of gas from line 12 can be increased, while the proportion from line 10 can be decreased. In this way the hydrogen:carbon monoxide molar ratio inside the reactor, as determined by analysis of stream 14 or stream 16, can be reduced. The reduction of the hydrogen:carbon monoxide molar ratio inside the reactor 105 in turn reduces the production rate of methane, relative to the production of the desired liquid hydrocarbon products. Once the off-gas composition reaches the required hydrogen:carbon monoxide molar ratio, the gas flow rates from lines 10 and 12 can be suitably adjusted to maintain the reaction conditions which produce the minimum quantity of by-product methane while maintaining catalyst activity.

Figure 3:
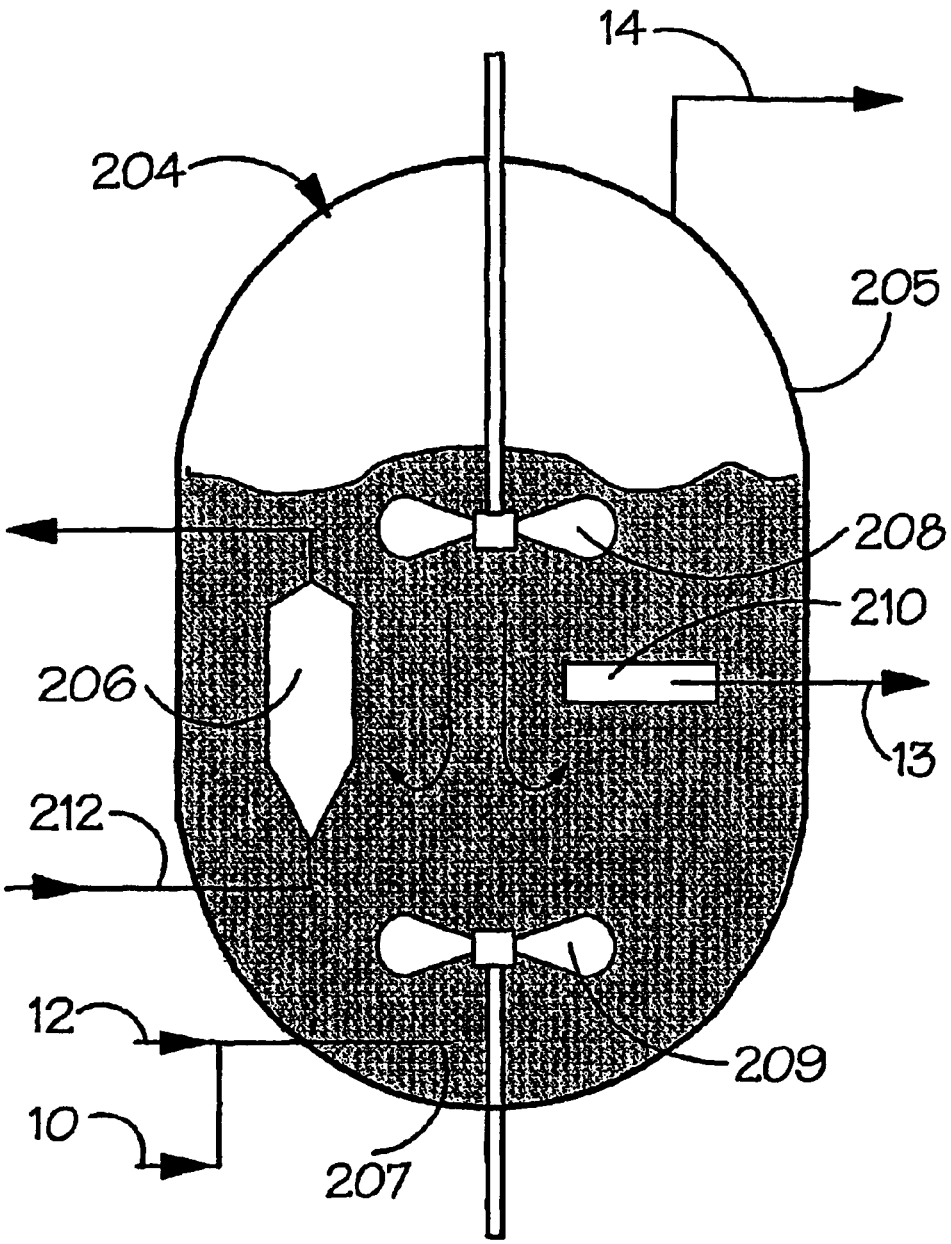
FIG. 3 shows a second form of reactor for use in the plant of FIG. 1.

FIG. 3 illustrates a further design of reactor 204 for use as the reactor 4 of the plant of FIG. 1. This comprises a reactor 205 of circular cross section with an internal heat exchanger 206 and with a sparger 207 for introduction of the feed synthesis gas from lines 10 and 12. Reactor is also fitted with axial stirrers 208 and 209 and with an internal filter 210 from which liquid Fischer Tropsch product can be withdrawn in line 13. Coolant for heat exchanger 206 is supplied in line 212. Offgas is recovered in line 14.

Due to the circular cross section of reactor 205 and stirrers 208 and 209 which are both rotated in a direction adapted to cause axial downflow of slurry within reactor 205 and upflow of slurry along an upward path adjacent to and substantially parallel to the walls of reactor 205, a toroidal flow path for slurry can be induced in reactor 205. This toroidal flow tends to cause incoming bubbles of gas from sparger 209 to travel initially downwardly thus increasing the dwell time of an individual gas bubble in the liquid phase and hence the amount of gas dissolved in the slurry.

In the plants of FIGS. 1 to 3 the gas supplied in line 10 is a mixture comprising hydrogen and carbon monoxide. In a variant of the process of the invention this stream is replaced by a hydrogen stream.

What is claimed is:

1. A process for producing a liquid hydrocarbon product from hydrogen and carbon monoxide which comprises:

(a) providing a reaction vessel containing a slurry of particles of a particulate Fischer Tropsch catalyst in a liquid medium comprising a hydrocarbon, the particles of catalyst having a particle size range such that no more than about 10% by weight of the particles of catalyst have a particle size which lies in an upper particle size range extending up to a maximum particle size, (b) supplying hydrogen and carbon monoxide to the reaction vessel, (c) maintaining in the reaction vessel reaction conditions effective for conversion of hydrogen and carbon monoxide to a liquid hydrocarbon product by the Fischer Tropsch reaction, (d) maintaining mixing conditions in the reaction vessel sufficient to establish a circulation pattern throughout the reaction vessel including an upflowing path for slurry and a downflowing path for slurry the upward velocity of the slurry in the upflowing slurry path being greater than about 75% of the mean downward velocity of the particles of catalyst of the upper particle size range when measured in stagnant liquid medium, the reaction vessel being substantially devoid of stagnant zones wherein the catalyst particles can settle out of the slurry, (e) recovering from the reaction vessel a liquid stream comprising the liquid hydrocarbon product; and (f) recovering from the reaction vessel an off gas stream comprising methane as well as unreacted hydrogen and carbon monoxide.

2. A process for production of a liquid hydrocarbon product from carbon monoxide and hydrogen which comprises:

(a) providing a reaction vessel containing a slurry of a particulate Fischer Tropsch catalyst in a liquid medium comprising hydrocarbon;

(b) providing a first gas stream selected from hydrogen and a synthesis gas mixture comprising hydrogen and carbon monoxide in a molar ratio greater than about 2:1;

(c) providing a second gas stream comprising hydrogen and carbon monoxide in a molar ratio less than about 2:1;

(d) continuously supplying material of the first gas stream and material of the second gas stream to the reaction vessel;

(e) maintaining back mixed circulation of the slurry in the reaction vessel whereby a circulation pattern is maintained throughout the reaction vessel without zones of stagnation wherein particles of the particulate Fischer Tropsch catalyst settle out;

(f) maintaining conditions of temperature and pressure within the reaction vessel effective for conversion of hydrogen and carbon monoxide by the Fischer Tropsch reaction to a liquid hydrocarbon product;

(g) recovering from the reaction vessel an offgas stream comprising methane as well as unreacted hydrogen and carbon monoxide; (h) monitoring the composition of the offgas stream; and (i) adjusting the hydrogen:carbon monoxide molar ratio in the reaction vessel in dependence upon the composition of the offgas stream by varying the flow rate to the reaction vessel of at least one gas stream selected from the first gas stream and the second gas stream so as to maintain in the reaction vessel conditions conducive to synthesis of the liquid hydrocarbon product.

3. A process according to claim 1, wherein the reaction vessel is operated at a temperature of from about 180° C. to about 250° C.

4. A process according to claim 1, wherein the reaction vessel is operated at a pressure of from about 1000 kPa to about 5000 kPa absolute total pressure.

5. A process according to claim 1, wherein the reaction vessel is operated at a pressure of from about 2000 kPa to about 4000 kPa absolute total pressure.

6. A process according to claim 1, wherein energy dissipation in the reaction vessel is between about 0.2 $kW/m^3$ and about 20 $kW/m^3$.

7. A process according to claim 1, wherein energy dissipation in the reaction vessel is between about 1.5 $kW/m^3$ and about 7 $kW/m^3$.

8. A process according to claim 1, wherein the particulate Fischer Tropsch catalyst comprises a Group VIII metal.

9. A process according to claim 8, wherein the particulate Fischer Tropsch catalyst comprises cobalt.

10. A process according to claim 1, wherein the catalyst particles fall within the size range of from about 2 $\mu$m to about 100 $\mu$m.

11. A process according to claim 10, wherein the catalyst particles fall within the size range of 5 $\mu$m to 50 $\mu$m.

12. A process according to claim 1, wherein the upward velocity of the slurry in the upflowing slurry path is greater than the downward velocity of the largest particle of catalyst when measured in stagnant liquid medium.

13. A process according to claim 1, wherein the circulation pattern is a single toroidal circulation pattern.

14. A process according to claim 1, wherein at least a part of the offgas stream is recirculated to the reaction vessel.

15. A process according to claim 1, wherein the gas streams are provided to the reaction vessel in a plurality of locations.

16. A process according to claim 15, wherein the locations are zones of high turbulence.

17. A process according to claim 1, wherein a main gas stream is provided to a top head space of the reaction vessel.

18. A process according to claim 1, wherein a main gas stream is provided to a bottom head portion of the reaction vessel.

19. A process according to claim 1, wherein fresh catalyst is added to the reaction vessel during operation.

20. A process according to claim 2, wherein the reaction vessel is operated at a temperature of from about 180° C. to about 250° C.

21. A process according to claim 2, wherein the reaction vessel is operated at a pressure of from about 1000 kPa to about 5000 kPa absolute total pressure.

22. A process according to claim 2, wherein the reaction vessel is operated at a pressure of from about 2000 kPa to about 4000 kPa absolute total pressure.

23. A process according to claim 2, wherein energy dissipated in the reaction vessel is between about 0.2 $kW/m^3$ and about 20 $kW/m^3$.

24. A process according to claim 2, wherein energy dissipation in the reaction vessel is between about 1.5 $kW/m^{+}$and about 7 $kW/m^3$.

25. A process according to claim 2, wherein the particulate Fischer Tropsch catalyst comprises a Group VIII metal.

26. A process according to claim 25, wherein the particulate Fischer Tropsch catalyst comprises cobalt.

27. A process according to claim 2, wherein the catalyst particles fall within the size range of from about 2 $\mu$m to about 100 $\mu$m.

28. A process according to claim 27, wherein the catalyst particles fall within the size range of from about 5 $\mu$m to about 50 $\mu$m.

29. A process according to claim 2, wherein the upward velocity of the slurry in the upflowing slurry path is greater than the downward velocity of the largest particle of catalyst when measured in stagnant liquid medium.

30. A process according to claim 2, wherein the circulation pattern is a single toroidal circulation pattern.

31. A process according to claim 2, wherein at least a part of the offgas stream is recirculated to the reaction vessel.

32. A process according to claim 2, wherein the gas streams are provided to the reaction vessel in a plurality of locations.

33. A process according to claim 32, wherein the locations are zones of high turbulence.

34. A process according to claim 2, wherein a main gas stream is provided to a top head space of the reaction vessel.

35. A process according to claim 2, wherein a main gas stream is provided to a bottom head portion of the reaction vessel.

36. A process according to claim 2, wherein fresh catalyst is added to the reaction vessel during operation.

* * * * *